US011359644B2

(12) United States Patent
Loercher et al.

(10) Patent No.: US 11,359,644 B2
(45) Date of Patent: Jun. 14, 2022

(54) VENTILATOR AND DEFLECTOR PLATE FOR A VENTILATOR

(71) Applicant: ZIEHL-ABEGG SE, Künzelsau (DE)

(72) Inventors: Frieder Loercher, Braunsbach (DE); Lothar Ernemann, Heilbronn (DE)

(73) Assignee: ZIEHL-ABEGG SE, Künzelsau (DE)

( * ) Notice: Subject to any disclaimer, the term of this patent is extended or adjusted under 35 U.S.C. 154(b) by 0 days.

(21) Appl. No.: 17/261,506

(22) PCT Filed: May 28, 2019

(86) PCT No.: PCT/DE2019/200048
§ 371 (c)(1),
(2) Date: Jan. 19, 2021

(87) PCT Pub. No.: WO2020/015792
PCT Pub. Date: Jan. 23, 2020

(65) Prior Publication Data

US 2021/0262488 A1 Aug. 26, 2021

(30) Foreign Application Priority Data

Jul. 16, 2018 (DE) ..... 102018211808.6

(51) Int. Cl.
*F04D 29/54* (2006.01)
*F04D 29/52* (2006.01)

(52) U.S. Cl.
CPC ..... *F04D 29/542* (2013.01); *F04D 29/522* (2013.01)

(58) Field of Classification Search
None
See application file for complete search history.

(56) References Cited

U.S. PATENT DOCUMENTS 4,828,456 A * 5/1989 Bodzian ..... F04D 29/444 415/211.1
4,899,860 A * 2/1990 Diederich ..... F16D 35/00 192/58.4
5,296,769 A * 3/1994 Havens ..... A47L 5/22 310/58
5,848,526 A 12/1998 Hanson
5,984,649 A * 11/1999 Kato ..... F24F 1/0057 417/423.5
8,939,718 B2 1/2015 Claus et al.
11,168,696 B2 * 11/2021 Myers McCarthy ..... F04D 29/664
2010/0247344 A1 * 9/2010 Yang ..... F04D 29/384 417/410.1
2010/0272567 A1 * 10/2010 Horng ..... F04D 25/0613 415/208.2

(Continued)

FOREIGN PATENT DOCUMENTS

DE 102015207800 A1 11/2016
EP 2792885 A1 10/2014

(Continued)

*Primary Examiner* — Michael Lebentritt
(74) *Attorney, Agent, or Firm* — Jason P. Mueller; FisherBroyles, LLP

(57) ABSTRACT

A fan, such as an axial, radial, or diagonal fan, includes a fan impeller and an outlet guide device located in a housing/flow channel downstream of the fan impeller. The outlet guide device may include outlet guide blades that, when viewed in the spanwise direction or radial direction, extend over only a portion of the flow area.

19 Claims, 12 Drawing Sheets

(56) References Cited

U.S. PATENT DOCUMENTS

Figure 1:
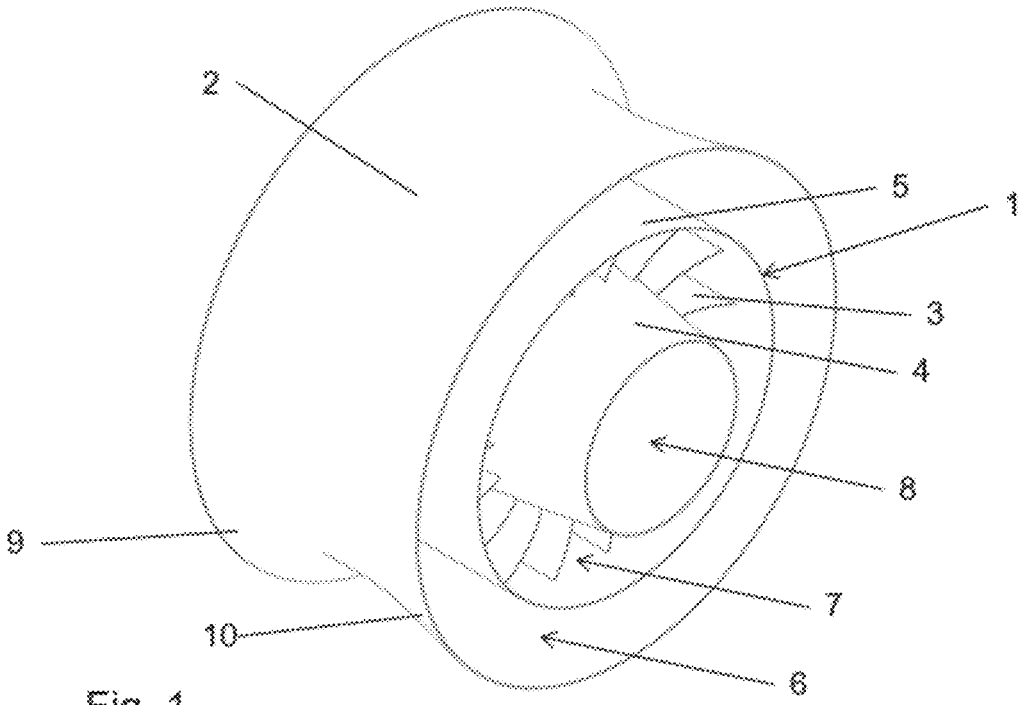

2011/0097226 A1* 4/2011 Nakamura ..... F04D 25/08 417/423.14
2011/0200438 A1* 8/2011 Ruckert ..... F04D 29/624 416/180
2012/0039731 A1 2/2012 Sadi et al.
2013/0044430 A1* 2/2013 Carl, Jr. ..... H05K 7/20772 361/695
2014/0023516 A1* 1/2014 Ruck ..... F04D 17/06 416/242
2014/0314559 A1* 10/2014 Khalitov ..... F04D 19/005 415/208.1
2015/0176851 A1* 6/2015 Avedon ..... F24F 13/06 454/292
2015/0184662 A1* 7/2015 Fisher ..... F04D 29/441 415/203
2016/0218570 A1* 7/2016 Jang ..... H02K 9/06
2017/0175747 A1* 6/2017 Gundel ..... F04D 29/282
2018/0026486 A1* 1/2018 Jo ..... A47L 9/22 15/412
2018/0087535 A1* 3/2018 Heli ..... F04D 17/16
2018/0180050 A1 6/2018 Hayamitsu
2018/0209438 A1* 7/2018 Decker ..... F04D 29/329
2018/0335244 A1* 11/2018 Haaf ..... F24F 11/43
2019/0032676 A1* 1/2019 Lind ..... F04D 17/16
2019/0353364 A1* 11/2019 Loercher ..... F04D 29/626
2020/0124055 A1* 4/2020 Choi ..... F04D 29/325
2020/0200187 A1* 6/2020 Weinzierl ..... F04D 29/4226
2021/0262487 A1* 8/2021 Loercher ..... F04D 29/281

FOREIGN PATENT DOCUMENTS

FR 2922610 A1 4/2009
RU 2578070 C2 3/2016
RU 2639241 C1 12/2017
WO 8502889 A1 7/1985

* cited by examiner

VENTILATOR AND DEFLECTOR PLATE FOR A VENTILATOR

This application is a national stage entry under 35 U.S.C. 371 of PCT Patent Application No. PCT/DE2019/200048, filed May 28, 2019, which claims priority to German Patent Application No. 10 2018 211 808.6, filed Jul. 16, 2018, the entire contents of each of which are incorporated herein by reference.

The present disclosure relates to a fan, in particular an axial, radial, or diagonal fan, having a fan impeller and an outlet guide device arranged downstream thereof in the housing/flow channel, the outlet guide device having outlet guide blades.

Free running diagonal or radial fans, in particular those that have blades that are curved backward, are well known in practical use. In such fans, no flow guiding parts such as a spiral housing, outlet guide blades, diffusers, or the like are positioned downstream of the impeller outlet. The airflow exits the impeller at high flow velocities. The dynamic pressures associated with these flow velocities are not utilized with free running diagonal or radial fans. That means pressure and energy losses. As a consequence, such fans have inadequate pressure increases, inadequate air performance, and inadequate efficiency. Moreover, these high flow velocities at the outlet produce excessively high noise emissions. Furthermore, struts are frequently used to attach the motor fan wheel to a nozzle plate, and these struts usually pass very close to the impeller outlet. Thus they present an obstacle in the flow path and have an additional negative impact on air performance, efficiency, and acoustics. However, free running diagonal or radial fans are frequently compact, meaning they take up a small, often square space in a higher-level system and are inexpensive to produce.

From EP 2 792 885 A1 a radial fan has a circular, bladed outlet guide wheel on the air outlet side for the purpose of improved air circulation. Said outlet guide wheel serves simultaneously as a suspension, but does not contribute to improved efficiency. The outlet guide wheel comprises a cover plate and a base plate, each of which, in the mounted state, extends the corresponding cover plate or base plate of the impeller, and comprises guide blades, which are arranged partially between the cover plate and base plate of the outlet guide wheel but which extend beyond the outer edges thereof as viewed in the direction of flow. As a result, the outlet guide wheel produces substantial noise. A further disadvantage of the known radial fan is the fact that, as viewed in the direction of flow, the guide device cover plate and the guide device base plate diverge substantially from one another, i.e. the flow cross-section widens significantly in the direction of flow. This leads to turbulence in the region of the guide device, where it increases noise creation and at the same time reduces air performance and thus efficiency.

Embodiments of the present disclosure relate to configuring and refining the generic fan such that these and other problems are at least largely eliminated. While maintaining the lowest possible noise level, static efficiency should be increased over a broad range of the performance curve. Additionally, the fan according to the instant disclosure should be distinguished from competitive products.

A corresponding outlet guide device will also be specified.

The above-stated embodiments are described further herein, and embrace features where the outlet guide device of the generic fan has a particular structural design; specifically, the outlet guide blades, as viewed in the spanwise direction, extend over only a portion of the flow area.

Alternatively, according to some embodiments, two flow-through regions may be formed downstream of the impeller, the inner flow-through region closer to the axis as viewed in the spanwise direction being delimited by the hub ring of the guide device and by the outer ring of the guide device, and the outer flow-through region farther away from the axis as viewed in the spanwise direction being delimited by the outer ring of the guide device and by the wall of the housing.

The outlet guide device of the disclosure according to still further embodiments is correspondingly configured.

Apart from the increase in static efficiency or the maintenance of low noise levels, the compact configuration of the outlet guide device, the outlet guide blades of which extend over only a portion of the span of the associated impeller, has a positive effect on the costs of tools and parts. Due to the comparatively small diameter of the outlet guide device, which is based on a given impeller diameter, the tool size of associated injection molding tools is lower than is otherwise customary. This is especially true in the case of axial fans.

In addition, correspondingly configured radial fans are suitable particularly for installation into narrow channels that have an axial flow path.

Since a highly detailed description of various exemplary embodiments with reference to the figures will be provided further below, at this point a general description of the teaching will be dispensed with.

Figure 2:
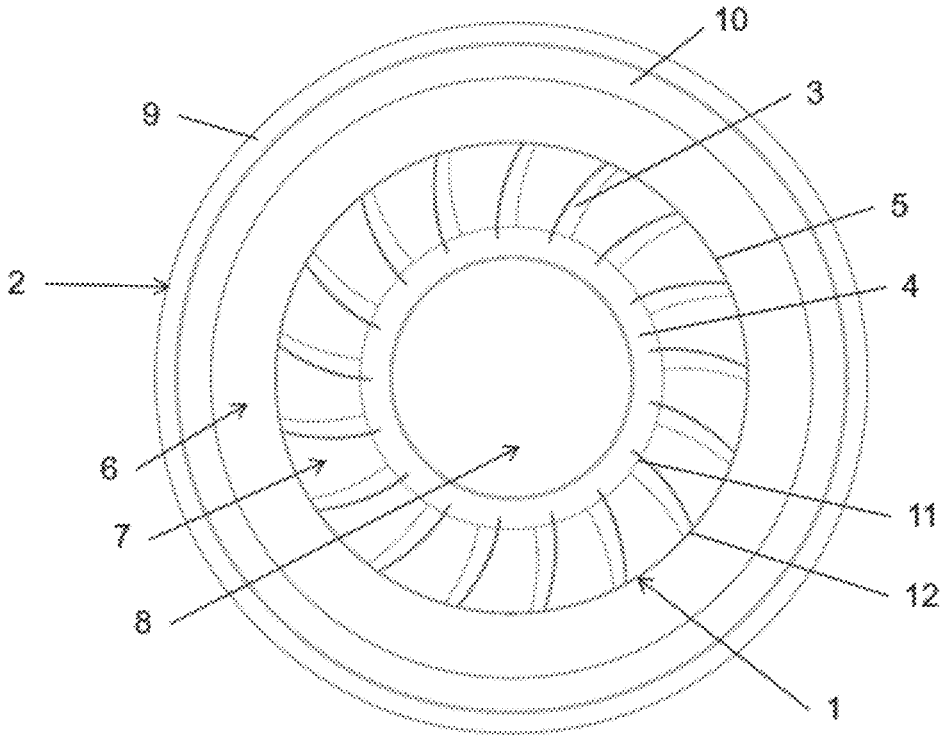
Figure 3:
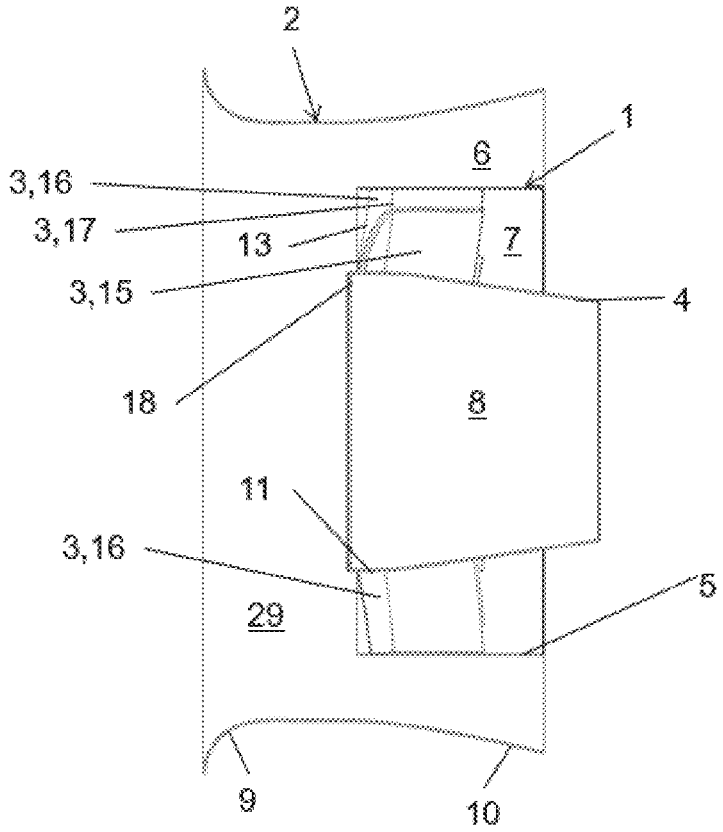
Figure 3A:
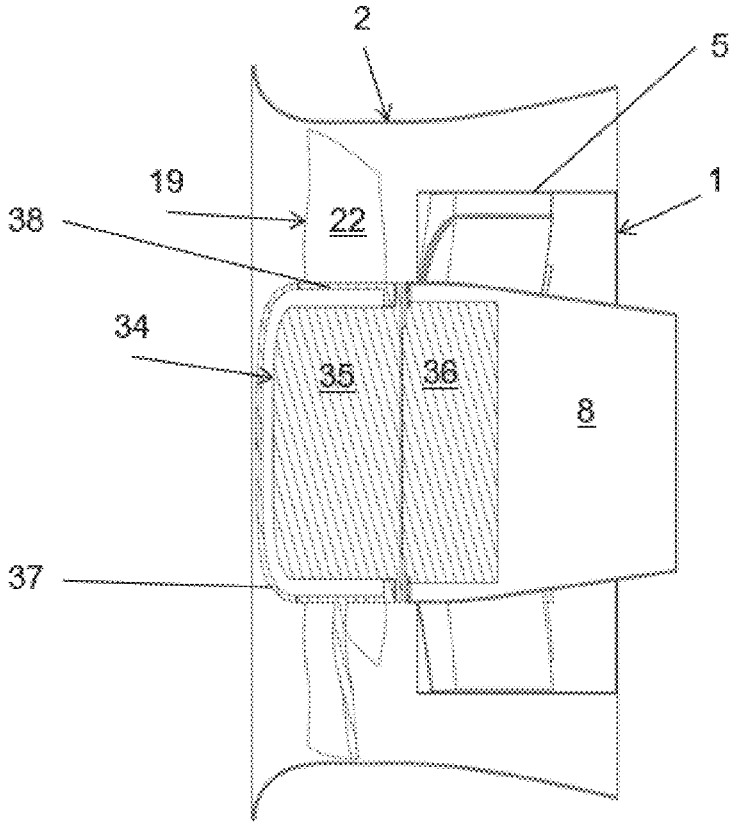
Figure 4:
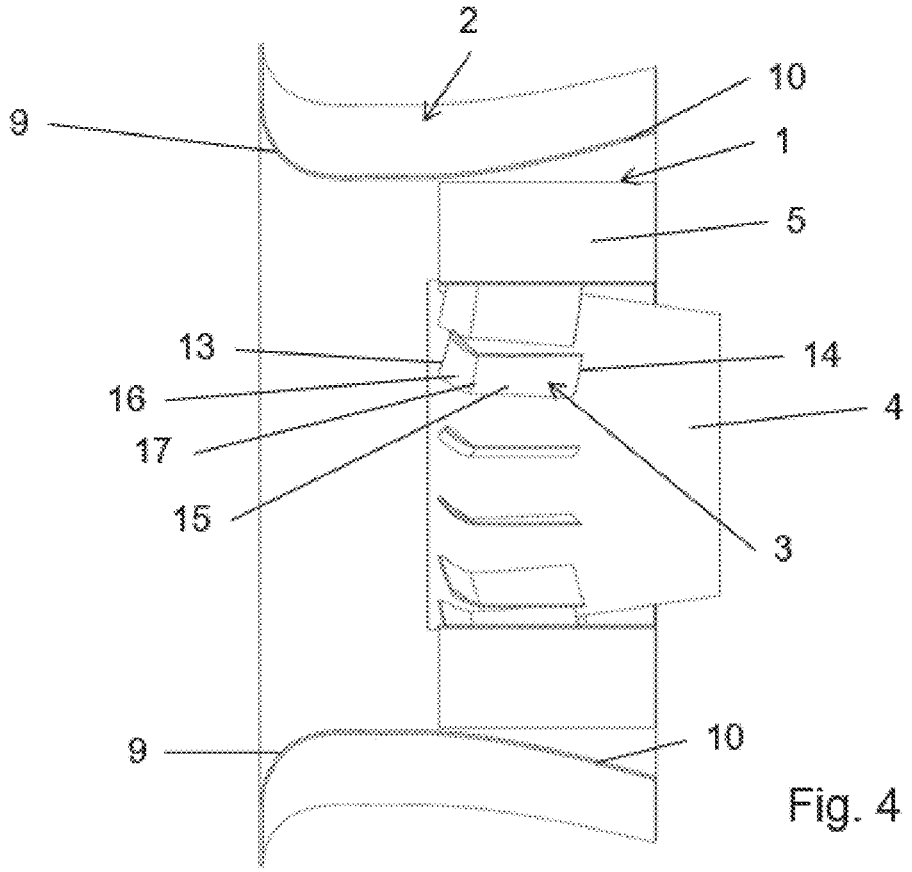
Figure 5:
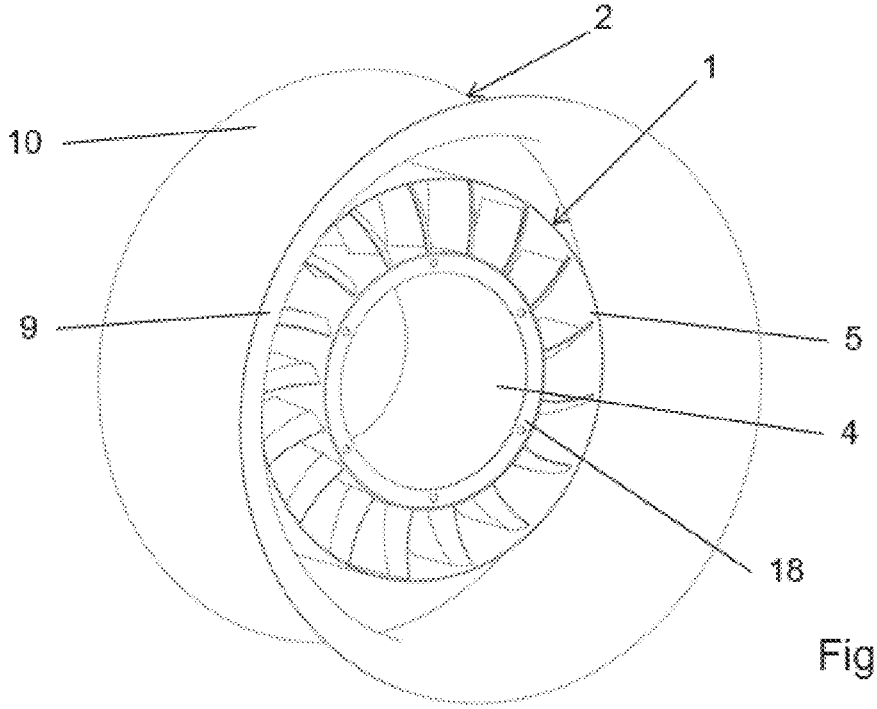
Figure 6:
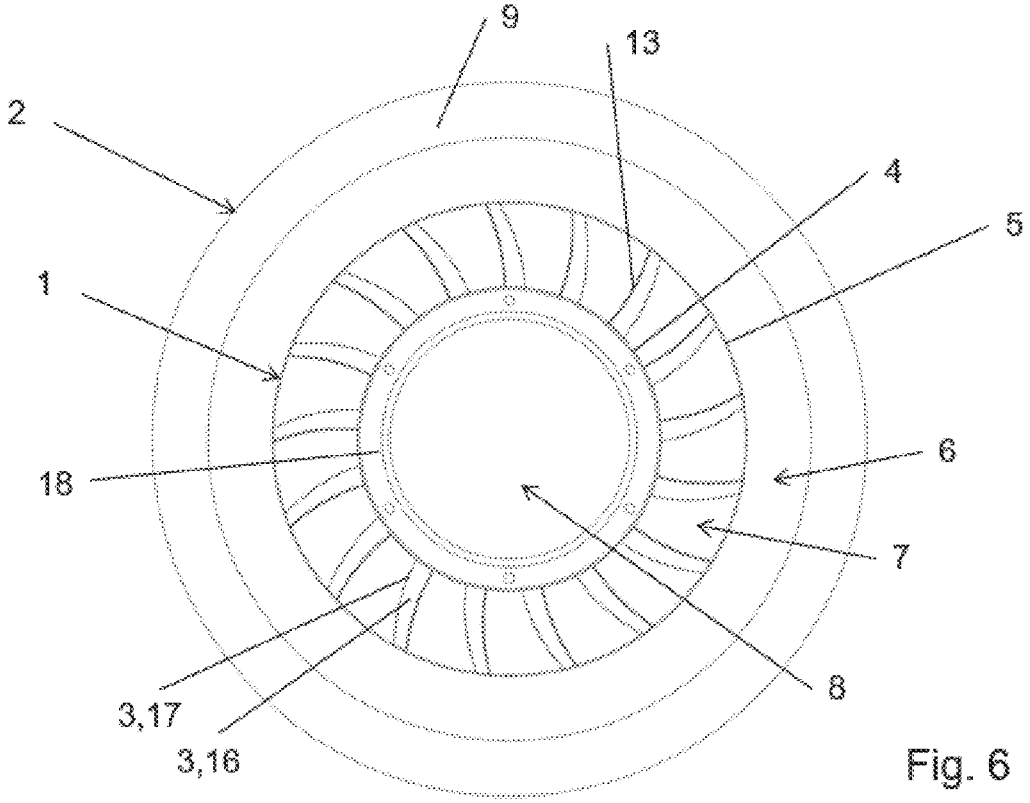
Figure 7:
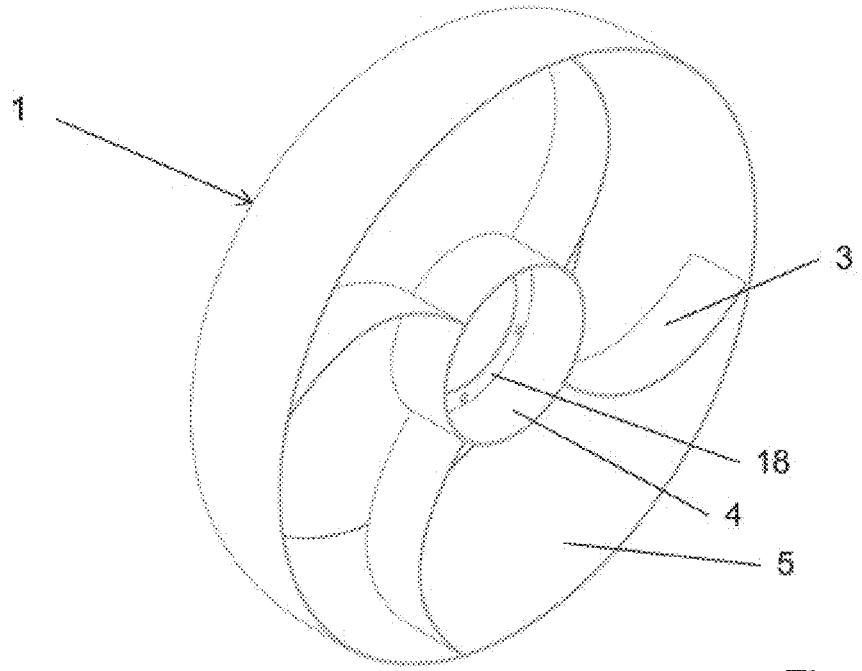
Figure 8:
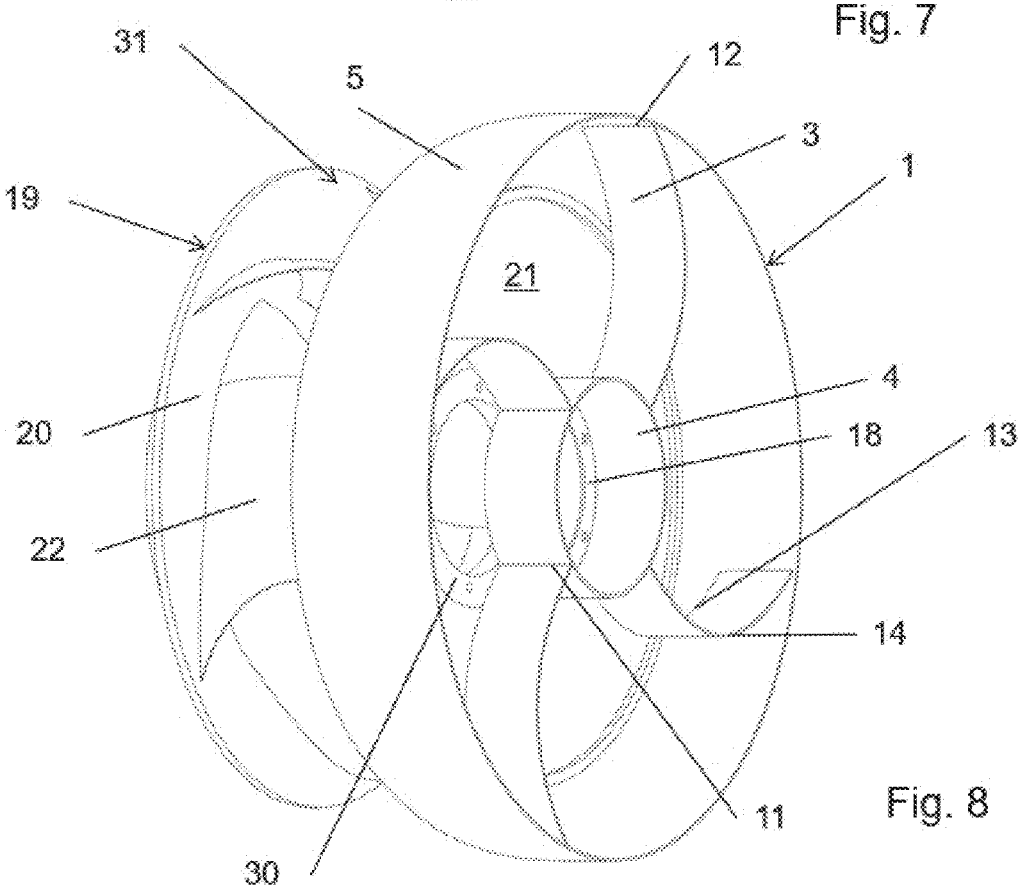
Figure 9:
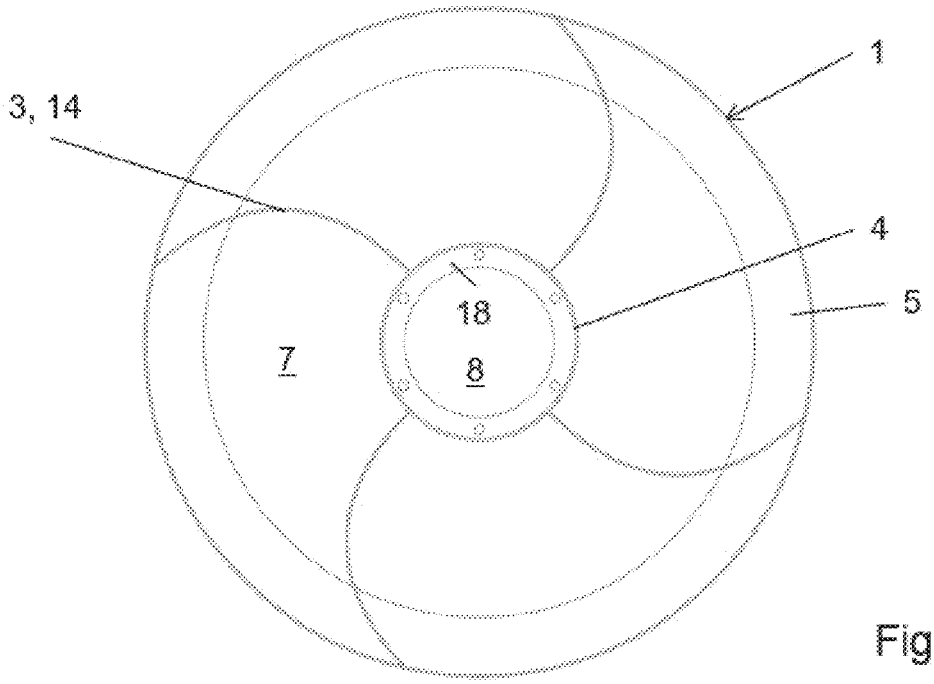
Figure 10:
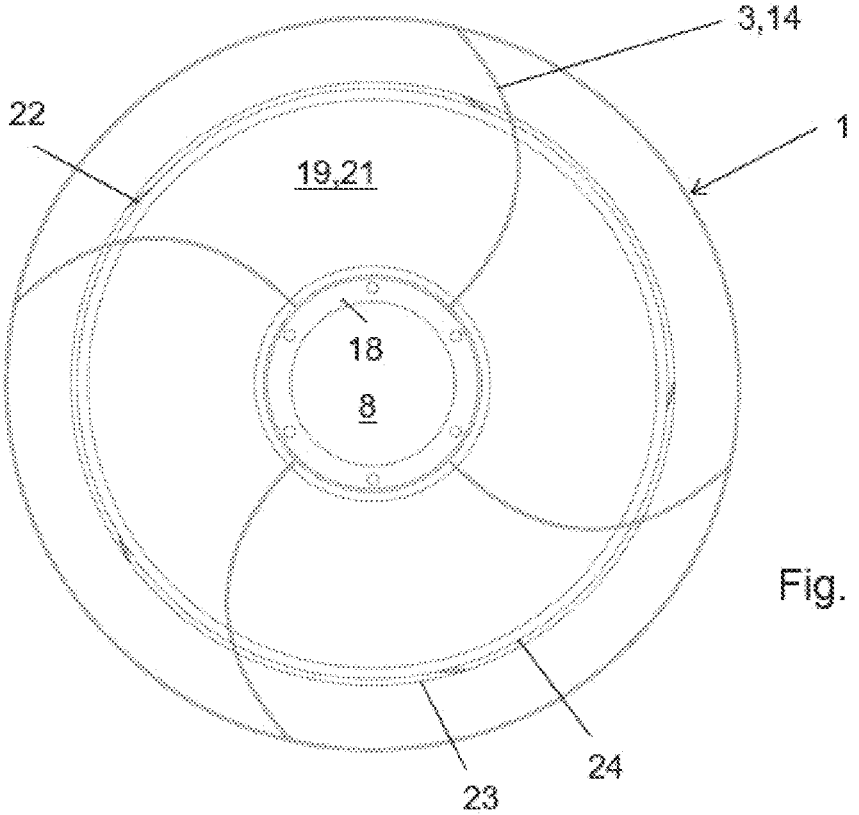
Figure 11:
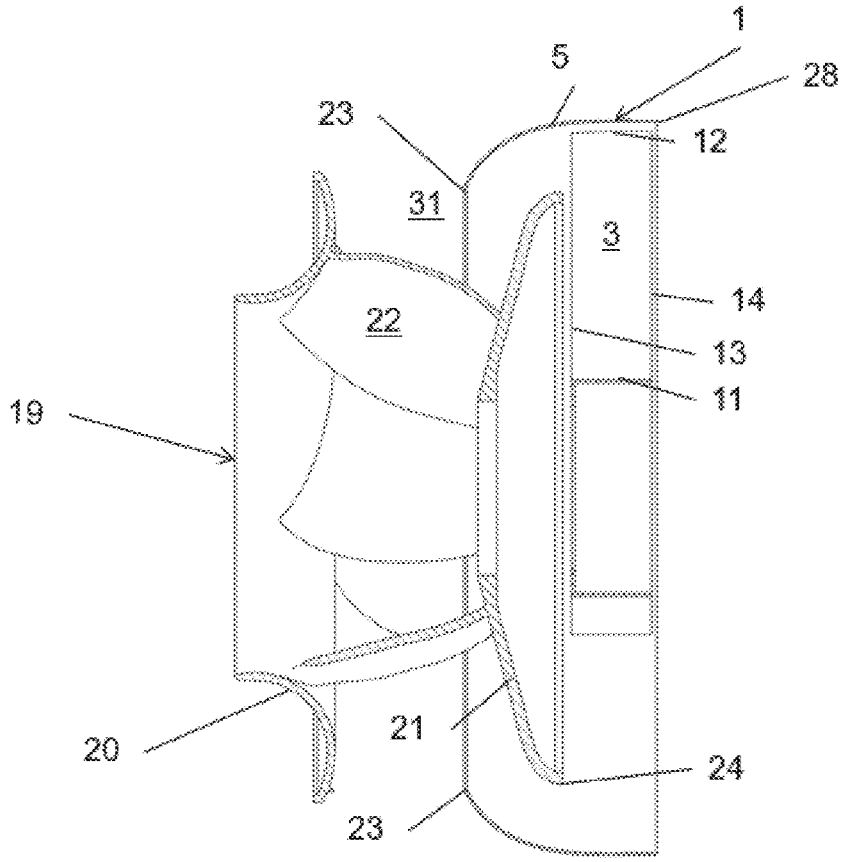
Figure 12:
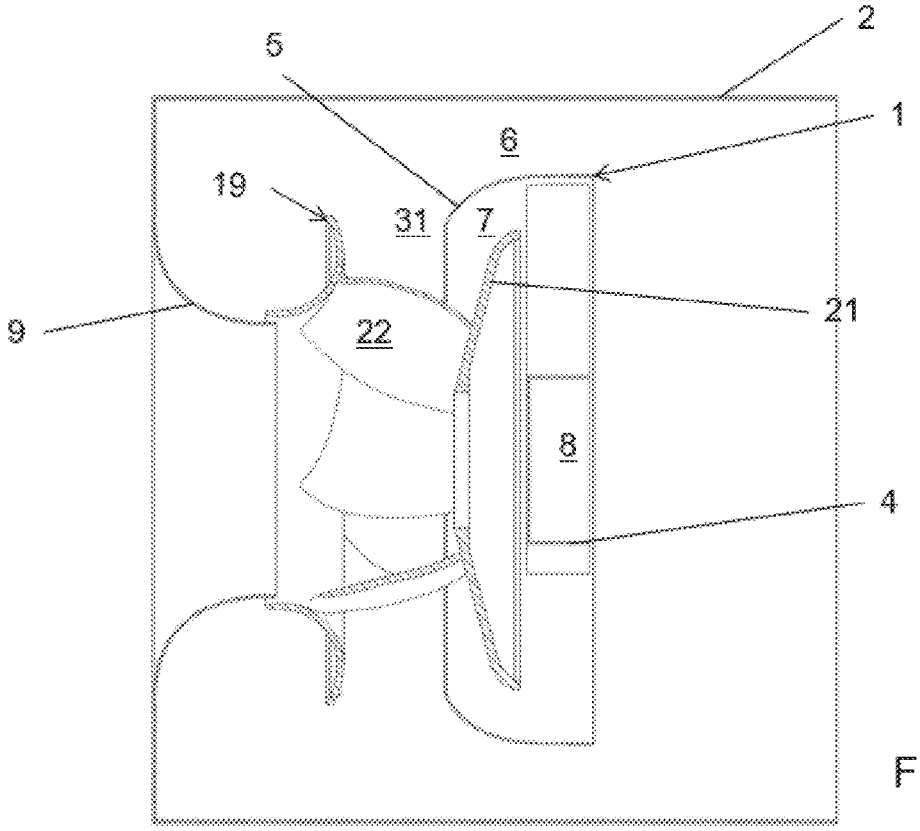
Figure 12A:
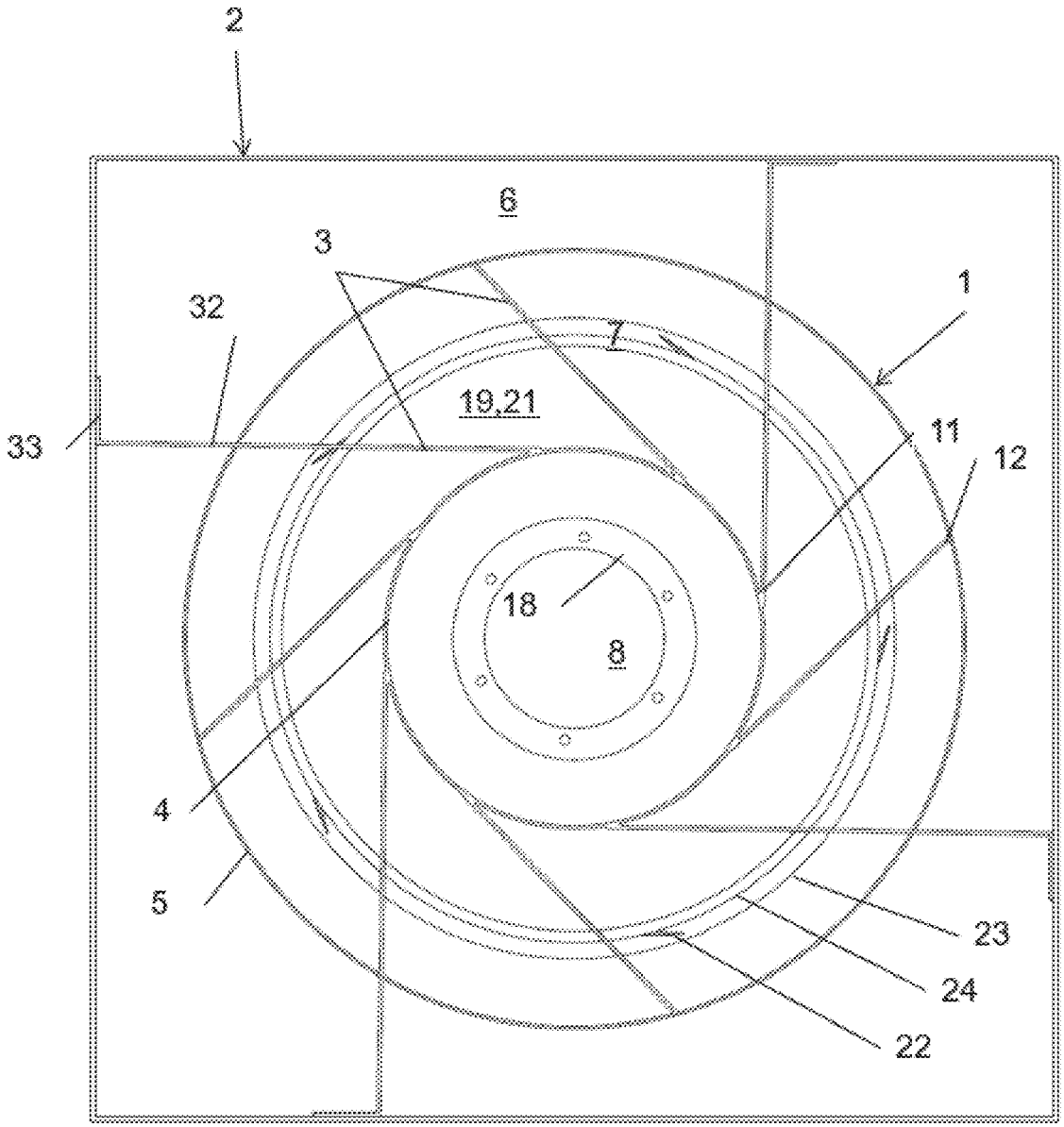
Figure 13:
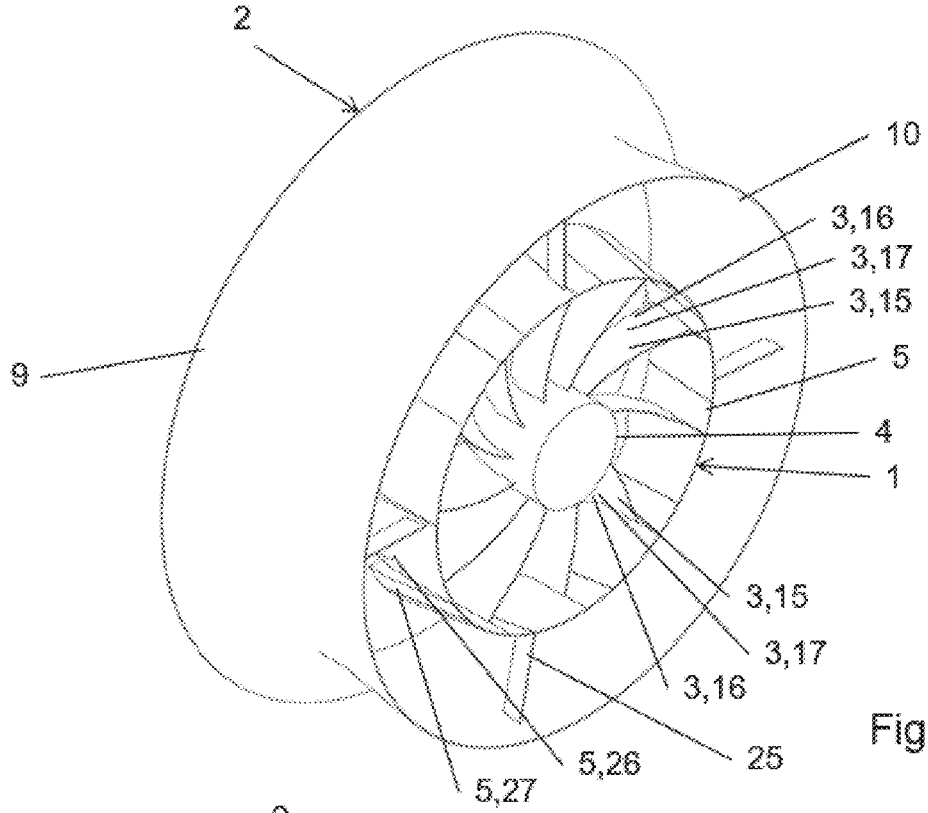
Figure 14:
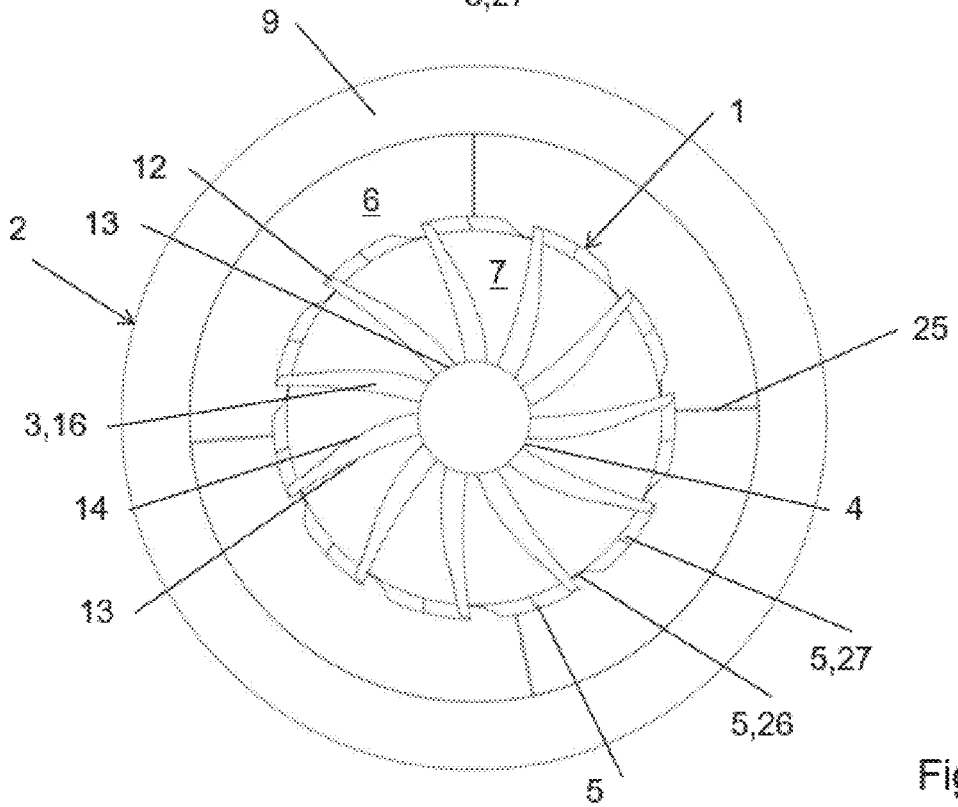
Figure 15:
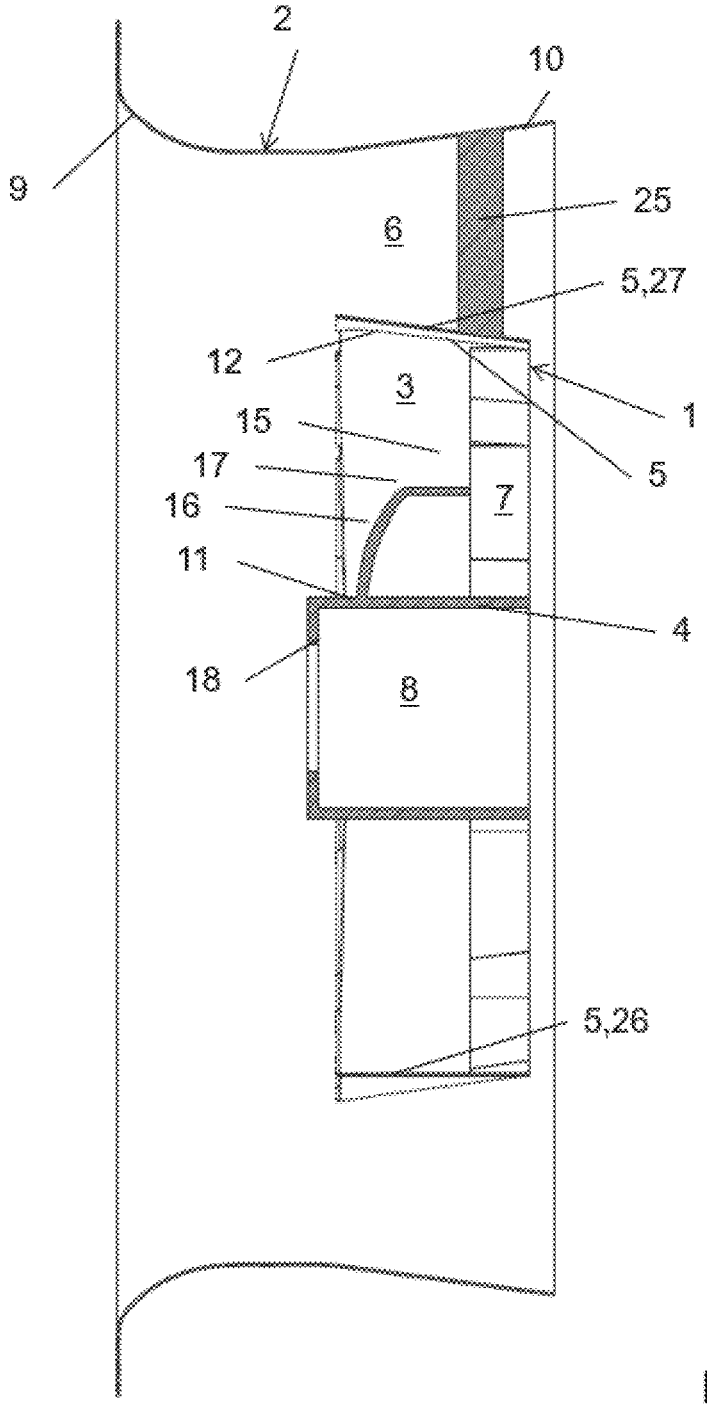
Figure 16:
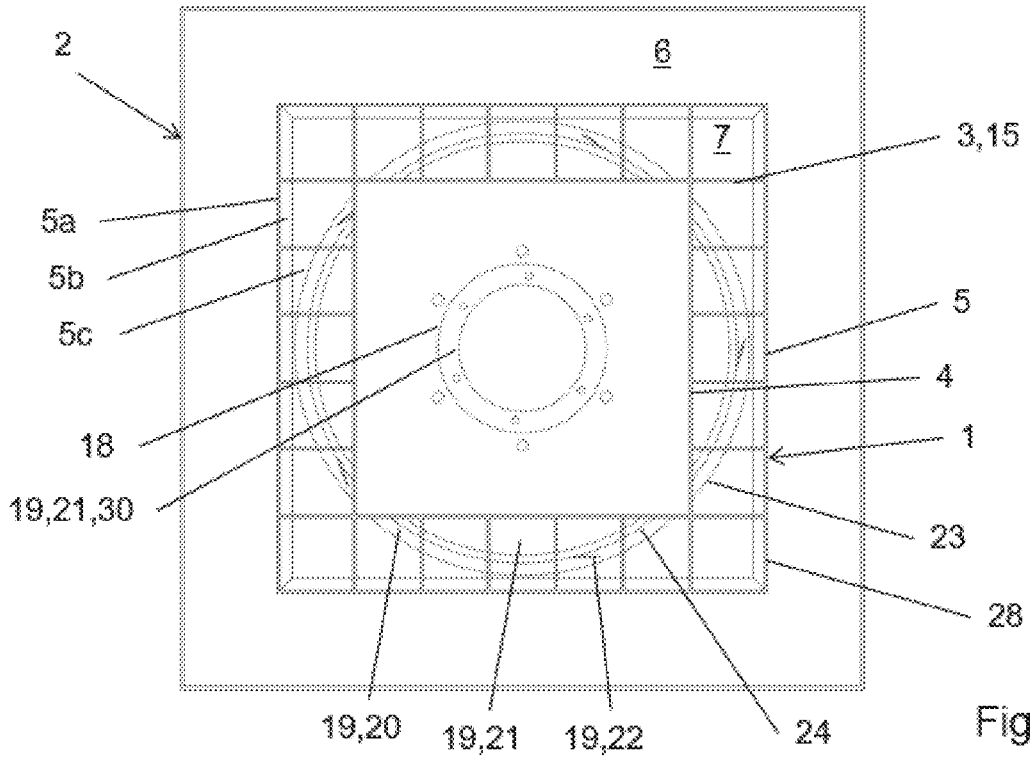
Figure 17:
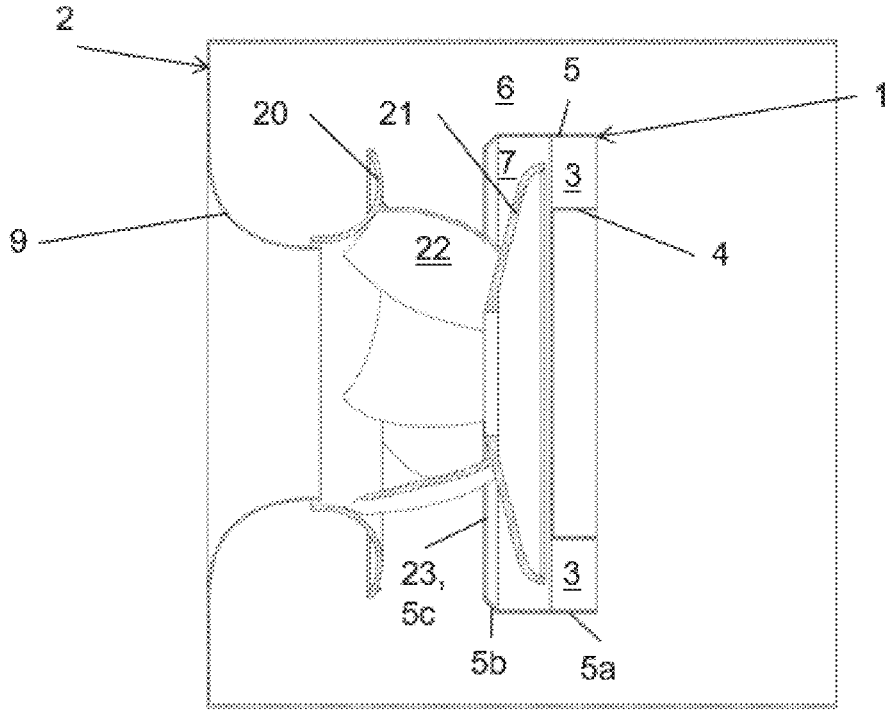
Figure 18:
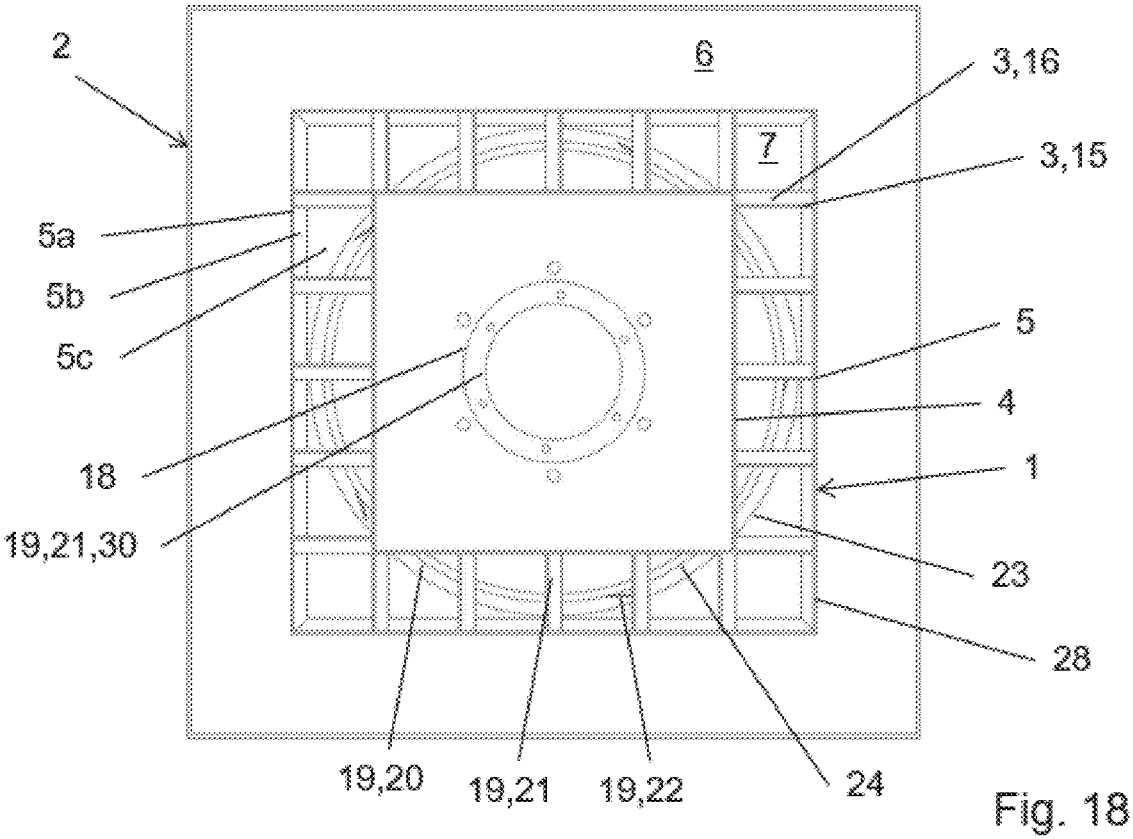

There are various options for the advantageous embodiments and refinement of the teachings of the present disclosure. Reference is made in this regard to the following detailed description of preferred exemplary embodiments, and with reference also to the set of drawings. In conjunction with the detailed description of the preferred exemplary embodiments and with reference to the set of drawings, preferred configurations and refinements of the teaching will also be described. In the drawings:

FIG. 1 is a perspective view, as seen from the outflow side, of a guide device and a housing of an exemplary embodiment of a fan of axial design according to some embodiments, FIG. 2 is an axial plan view, as seen from the outflow side, of the guide device and the housing of FIG. 1, FIG. 3 is a sectional view from the side, along a plane through the axis, of the guide device and the housing of FIGS. 1 and 2, FIG. 3*a* is a sectional view from the side, along a plane through the axis, of the guide device and the housing of FIGS. 1 to 3, with an installed impeller and a schematically depicted motor, FIG. 4 is a sectional view from the side, along a plane parallel to the axis, of the guide device and the housing of FIGS. 1 to 3, FIG. 5 is a perspective view, as seen from the intake side, of the guide device and the housing according to FIGS. 1 to 4, FIG. 6 is an axial plan view, as seen from the intake side, of the guide device and the housing according to FIGS. 1 to 5, FIG. 7 is a perspective view, as seen from the outflow side, of a guide device of a further exemplary embodiment of a fan of radial or diagonal design according to some embodiments, FIG. 8 is a perspective view, as seen from the outflow side, of the guide device according to FIG. 7 with an associated impeller of radial design, FIG. 9 is an axial plan view, as seen from the outflow side, of the guide device according to FIG. 7, FIG. 10 is an axial plan view, as seen from the outflow side, of the guide device and the impeller according to FIG. 8, FIG. 11 is a sectional view from the side, along a plane through the axis, of the guide device and the impeller according to FIGS. 8 and 10, FIG. 12 is a sectional view from the side, along a plane through the axis, of the guide device and the impeller according to FIGS. 8 and 10, installed in a discharge-side housing with an intake nozzle associated with the impeller, FIG. 12*a* is an axial plan view, as seen from the outflow side, of a housing, a guide device, and an impeller of a further embodiment, depicting the suspension mounting, into which a number of guide elements of the guide device are integrated, FIG. 13 is a perspective view, as seen from the outflow side, of a guide device and a housing of a further exemplary embodiment of a fan of axial design, FIG. 14 is an axial plan view, as seen from the intake side, of the guide device and the housing according to FIG. 13, FIG. 15 is a sectional side view, along a plane through the axis, of the guide device and the housing according to FIGS. 13 and 14, FIG. 16 is an axial plan view, as seen from the outflow side, of a housing, a guide device, and an impeller of a further embodiment, in which the guide device is made of sheet metal, FIG. 17 is a sectional side view, along a plane through the axis, of the housing, the guide device, and the impeller according to FIG. 16, FIG. 18 is an axial plan view, as seen from the outflow side, of a housing, a guide device, and an impeller of a further embodiment, in which the guide device is made of sheet metal and the guide elements have an adjusted part.

FIG. 1 shows a perspective view of a guide device 1 that acts as an outlet guide device, and a housing 2 of an exemplary embodiment of a fan of axial design. The guide device 1 includes a hub ring 4, an outer ring 5, and guide blades 3 extending therebetween. When the fan is in the assembled state, the guide device 1 is arranged downstream of an impeller (not shown) inside a housing 2, such that an air channel (of the outer flow-through region) 6 through which a portion of the air flowing outward from the impeller is guided is produced between the guide device 1 or the outer ring 5 thereof and the wall of the housing 2. Another portion of the air flowing outward from the impeller is guided through the inner flow-through region 7, which is delimited toward the axis by the hub ring 4, as viewed in the spanwise direction, and which is delimited toward the outer flow-through region 6 by the outer ring 5, as viewed in the spanwise direction. The inner flow-through region 7 is interspersed with guide blades/guide elements 3 (in the exemplary embodiment 13 of these, advantageously 3-19 of these), which stabilize the swirling flow exiting the impeller near the axis by reducing the swirling in the flow. This increases the efficiency. The hub ring 4 and the outer ring 5 extend over the entire circumference around the axis. The hub ring 4 surrounds an inner receiving region 8, in which the drive motor for the fan can be arranged, for example. There is no flow through the receiving region 8, or advantageously only a small air volume flow passes through said region (0.1%-2% of the total air volume flow) to allow the heat produced by the motor to be carried away.

The outer flow-through region 6 as a whole has no further guide elements, at least over a large area, as viewed in the spanwise direction. As a result, no or little additional noise is created in this area as a result of the interaction of the flow exiting the impeller and guide elements. This leads to highly noise-reduced operation, since particularly in this outer region 6, the flow velocities are high. A stabilization of the flow in the outer flow-through region 6 by guide elements is not crucial for the efficiency of the fan. Thus, a fan is obtained, which is low-noise specifically due to the fact that there are no guide elements in the outer flow-through region 6, or that only a small number of guide elements are present there, as compared with the inner flow-through region 7. Moreover, the fan has a high efficiency due to the flow stabilization produced by the guide elements 3 in the inner flow-through region 7.

FIG. 2 shows the guide device 1 and the housing 2 according to FIG. 1 in an axial plan view from the outflow side. The outer flow-through region 6, which has no guide elements in the exemplary embodiment, and the inner flow-through region 7 with the guide elements 3 are clearly visible. In this depiction, no connection is shown between guide device 1 and housing 2. However, in practice such a connection is necessary for attaching the guide device 1 to the housing 2. It can be achieved using a flat or rod-shaped metal material, or by implementing elements configured to aid flow, which connect the guide device 1 to the housing 2. Such a suspension, which may also extend through the outer flow-through region 6, cannot be regarded as an actual guide element and does not alter the statement that the outer flow-through region 6 has no additional guide elements.

In the exemplary embodiment, both the wall of the housing 2 and the hub ring 4 have a conical shape toward the outflow end. An outer diffusor 10 is thus integrated into the housing 2. Thus, both the inner flow-through region 7 and the outer flow-through region 6 are each configured as diffusors, with an expanding flow cross-section toward their outflow end. This is highly advantageous for static efficiency, particularly with axial fans. In the exemplary embodiment, the outer ring 5 of the guide device 1 is designed in the form of a cylindrical shell, aligned in the axial direction. This is advantageous particularly when the guide device is produced as a cast component, as in that case the demolding of the guide elements 3, which are attached at their outer end 12 to an outer ring 5, is greatly facilitated. For the same reason, it is also conceivable to configure a hub ring 4, to which the guide elements 3 are connected at their inner end 11, in the form of a cylindrical shell.

Measures to enable mounting, for example mounting flanges, can advantageously be integrated or attached to a housing 2 and/or a guide device 1, on both the intake side and the outflow side, which can serve to mount the fan in a higher-level system, for example an air conditioning system.

FIG. 3 shows a side and sectional view on a plane through the axis of guiding device 1 and housing 2 of FIGS. 1 and 2. In the sectional view, outer flow-through section 6 without guiding elements, inner flow-through section 7 with guiding elements 3 and receiving section 8 within hub ring 4 can be seen. When assembled, the impeller (not shown) is arranged in section 29 upstream of guiding device 1. When the fan is in operation, as seen in this view approximately from left to right, the air first flows through inlet nozzle 9 integrated with housing 2, then through the impeller (not shown), before it is partitioned between outer flow-through section 6 and inner flow-through section 7 in which the flow is stabilized (mainly in inner flow-through section 7) and in which kinetic energy of the flow is converted into pressure energy. In the area of receiving section 8 within hub ring 4, there is an arrangement or mimic 18 for fastening a motor.

Basically, there are two different support concepts for the motor with the impeller. On the one hand, guiding device 1 may be adapted to be load-bearing. This means it is stably connected (e.g., via struts, flat stock or aerodynamically configured sheet metal or plastic elements) to the housing in the area of its outer ring 5, and the motor, together with the impeller, is held on a motor fastening arrangement 18 in the inner section 8 of guiding device 1. On the other hand, guiding device 1 may not be adapted to be load-bearing, which means that the motor is fastened to a housing 2 using a support arrangement (in particular made of bar or flat stock) and a non-load-bearing guiding device 1 is then fastened to the motor or the associated support arrangement or fastened to housing 2 through a separate support device. In any case, parts of the support arrangement may pass outer flow-through section 6, where outer flow-through section 6 is substantially free of guiding elements across a large part of its spanwise extension.

In the exemplary embodiment, guiding elements 3 may have an advantageous configuration. In the inflow section, they may include a tilted part 16 adapted to the inflow direction, and in the outflow section, of an axially aligned part 15 and a transition section 17 located between parts 15 and 16. Here, transition section 17 is simply embodied as a bend. An inflow in the area of leading edge 13 of a guide vane 3, which is as smooth as possible, is beneficial for achieving high efficiency and low sound generation. This is ensured by tilted part 16 of guide vane 3, which is oriented approximately parallel to the direction of the swirling inflow coming from the impeller (see also FIG. 4). However, in combination with the conically configured hub ring 4, demolding of a tilted, i.e., not axially aligned, guide vane would be much more difficult because of undercuts. Therefore, part 15 of guide vane 3, located in areas of the conically configured hub ring, may be designed as an axially aligned part. This is also easy to see in FIG. 2 in areas in which inner end 11 of a guiding element 3 abuts the conical part of hub ring 4. Thus, hub ring 4 and guiding elements 3 along with outer ring 5 are demoldable in parallel to their orientation without undercuts if guiding device 1 is a casting, e.g., made by plastic injection molding. For undercut-free demolding of an integral guiding device 1 from a molding die, it is advantageous if hub ring 4 does not extend conically in the area of tilted part 16 of guide vane 3, but in the shape of a cylinder barrel, as in the exemplary embodiment shown. Thus, in the exemplary embodiment, hub ring 4 extends in the shape of a cylinder barrel in a first section, and rather conically in a second section.

FIG. 3*a* shows a side and sectional view on a plane through the axis of guiding device 1 and housing 2 of FIGS. 1 to 3 with an axial-type impeller 19 installed and motor 34 shown schematically, in particular including a rotor 35 and a stator 36. The impeller includes a hub ring 38 to which, advantageously, 3-13 impeller vanes 22 are fastened. Impeller 19 runs within housing 2 such that there is only a small gap between impeller vanes 22 and housing 2. Impeller 19 is fastened to rotor 35 of motor 34, driving impeller 19, by its hub ring 38. Guiding device 1 is fastened to stator 36 of motor 34. In load-bearing embodiments, guiding device 1 may be firmly connected to housing 2 by its outer ring 5 using suspension elements (not shown), in non-load-bearing embodiments, motor 34 may be firmly connected to housing 2 by its stator 36 via suspension elements (not shown).

Advantageously, the outer contour of impeller hub 38 may have the same or a similar outer diameter as the outer contour of hub ring 4 of guiding device 1, at least at the ends facing each other. This creates a substantially continuous flow-restricting contour towards the inner section close to the axis, which is very advantageous for high efficiency and low noise generation. Furthermore, in the exemplary embodiment, a hub cap 37 is attached to hub ring 38 of impeller 19 on the inflow side, which may have the outer contour of a semi-ellipse, for example, and which forms a continuous, inner flow-restricting contour with hub ring 38.

In the exemplary embodiment, motor 34 is an outrunner motor which is attached within hub rings 38 and 4 (or also in receiving section 8 within hub ring 4), resulting in a space-saving solution and compact design of the fan.

Advantageously, suitable measures (openings, holes, slots or the like) may create a slight volumetric air flow within hub rings 38 and 4 (or also in receiving section 8 within hub ring 4) to better discharge waste heat of motor 34.

FIG. 4 shows a side and sectional view on a plane parallel to the axis of guiding device 1 and housing 2 according to FIGS. 1 to 3. The sectional plane does not run through the axis, but is at a distance to it which is in the range of the average radius of guide vane 3. Thus, some guide vanes 3 are seen in section and their structure, as already described with reference to FIG. 3, can be seen even more clearly. On the inflow side, guide vanes 3 have a leading edge 13, and a corresponding trailing edge 14 on the outflow side. In the area of leading edge 13 in particular, tilted part 16 of a guide vane 3 is nearly parallel to the flow direction of the swirling flow coming from the impeller. An axially aligned part 15 of the guide vane is formed towards trailing edge 14. This configuration significantly facilitates demolding of a guiding device 1 having a conically configured hub ring 4 and/or conically configured outer ring 5 from a molding die. In the exemplary embodiment, transition 17 between parts 15 and 16 of a guide vane 3 is embodied as a bend, but may also be configured as a rounded section with a constant tangent or constant curvature, for example. The angle of tilted part 16 of a guide vane 3 at leading edge 13, for example, towards a line parallel to the axis is advantageously in a range between 20° and 50°. Advantageously, like in the exemplary embodiment, tilted part 16 of a guide vane 3 has the profile of an airfoil in its cross-section.

FIG. 5 shows a perspective view, seen from the inflow side, of guiding device 1 and housing 2 according to FIGS. 1 to 4. In operation, the air flows through inlet nozzle 9 into housing 2. From its leading edge, when air passes through, the flow duct defined by the wall of housing 2 or nozzle 9 may be tapered in the area of nozzle 9 up to a narrowest cross-section, thereby accelerating the air. An impeller is arranged at approximately the level of a narrowest cross-section of housing 2. The exemplary embodiment is particularly suited for an axial-type impeller. FIG. 5 clearly shows a fastening flange 18 within hub ring 4 with holes for fastening a motor.

Advantageously, guiding device 1 is manufactured in one piece e.g., by plastic injection molding. Compared to known outlet guide vanes extending up to the outer contour of housing 2, a significantly smaller injection molding die is required, saving die costs and production costs as a result of the small outer diameter of guiding device 1. Advantageously, housing 2 itself, including integrated inlet nozzle 9 and integrated outer diffusor 10, may be made of sheet metal in a cost-effective manner. Here, it may be contemplated to manufacture it from one or even multiple sheet metal parts which are then connected by screws, welding, rivets or the like.

FIG. 6 shows an axial top view, seen from the inflow side, of the guiding device and the housing according to FIGS. 1 to 5. It clearly shows outer flow-through section 6 and inner flow-through section 7, separated from each other by outer ring 5 of guiding device 1. Outer ring 5 is adapted to be axially aligned. Fastening flange 18 for fastening a motor is arranged in receiving section 8. For this embodiment of guide vanes 3, the diagram only shows tilted part 16 up to transition section 17.

In the embodiment shown, guide vanes 3 are configured in a crescent shape, i.e., leading edges 13 of guide vanes 7 are adapted to be curved in this view. Seen in the circumferential direction, the ends of leading edges 13 located at outer ring 5 are offset against the direction of rotation of the impeller from the ends of leading edges 13 located at hub ring 4. In this case, the direction of rotation of the impeller (not shown) relative to the given view direction is the clockwise direction.

FIG. 7 shows a perspective view, seen from the outflow side, of a guiding device 1 of another exemplary embodiment of a centrifugal- or mixed-flow-type fan. Guiding device 1 has 4 guiding elements 3, extending radially in a curved path from a hub ring 4 to an outer ring 5. A fastening flange 18 for fastening a motor is attached within hub ring 4. In the exemplary embodiment, guiding elements 3 are configured to be aligned in the axial direction and may advantageously be made of sheet metal. In the exemplary embodiment, outer ring 5 has the geometry of a solid of revolution around the axis.

FIG. 8 shows a perspective view, seen from the outflow side, of guiding device 1 according to FIG. 7 with an associated centrifugal-type impeller 19. In the exemplary embodiment, centrifugal impeller 19 substantially includes a cover plate 20, a base plate 21 and vanes 22 extending therebetween. The motor is not shown. On the stator side, it can be fastened to fastening flange 18 within hub ring 4 of the guiding device, and on the rotor side, to the corresponding fastening arrangement 30 on impeller 19. Guiding device 1 is arranged downstream after flow outlet 31 from centrifugal impeller 19; however, it does not extend across the entire span at flow outlet 31 from impeller 19 but only across a section located closer to base plate 21. In the exemplary embodiment, the contour of outer ring 5 of guiding device 1 causes a deflection of the air exiting radially from centrifugal impeller 19 to a more axial direction, a direction parallel to the axis.

FIG. 9 shows an axial top view, seen from the outflow side, of the guiding device according to FIG. 7. This diagram clearly shows that guiding elements 3, of which only trailing edge 14 can be seen, are aligned in the axial direction. A fastening arrangement 18 is attached in receiving section 8 within hub ring 4. In the view plane, guiding elements 3 are adapted to be curved, the curvature beginning from the inside at hub ring 4 and running outwardly towards outer ring 5 against the direction of rotation of an impeller. In the exemplary embodiment shown in this diagram, the direction of rotation of an impeller is the clockwise direction. Advantageously, the tilt angle of guiding elements 3 from the corresponding centrifugal direction has its maximum value at outer ring 5, the magnitude of which is greater than 20°, advantageously greater than 35°.

FIG. 10 shows an axial top view, seen from the outflow side, of guiding device 1 and impeller 19 according to FIG. 8. For the configuration of guiding device 1, see FIG. 9, for example. Outer rim 24 of base plate 21 of impeller 19 has a smaller outer diameter than inflow-side rim 23 of outer ring 5 of guiding device 1. This makes it possible to push guiding device 1 over base plate 21 of the impeller to better enable the assembly of the fan. In the diagram, parts of vanes 22 can be seen between outer rim 24 of base plate 21 of impeller 19 and inflow-side rim 23 of outer ring 5 of guiding device 1, which may be placed further outwardly radially, seen along their trailing edge or its path towards cover plate 20, than outer rim 24 of base plate 21. The direction of rotation of impeller 19 is the clockwise direction.

FIG. 11 shows a side and sectional view on a plane through the axis of guiding device 1 and impeller 19 according to FIGS. 8 and 10. The sectional view clearly shows the contour of outer ring 5 of guiding device 1, which is connected to radially outer ends 12 of guiding elements 3. It is heavily curved towards its inflow-side end 23 such that there is no or only a small angle of attack at the inflow-side end 23 of outer ring 5 relative to the flow flowing in the radial direction from impeller 19. On its path, it deflects this flow to an axial direction. Thus, it runs parallel to the axis at outflow-side rim 28. According to this exemplary embodiment, outer ring 5 alone (without guiding elements 3) can be demolded from a molding die free of undercuts. Guiding elements 3, advantageously made of sheet metal in the exemplary embodiment, can then be fastened to outer ring 5 of guiding device 1, such as by screws or snapping them on. Seen in the spanwise direction of impeller 19, guiding device 1 with outer ring 5 only extends across a part of flow outlet 31 from impeller 19. Regarding the outlet width of impeller 19 (=width, measured in the axial direction, of outlet 31 from impeller 19, seen in the axial cross-section from cover plate 20 to base plate 21), inflow-side rim 23 of outer ring 5 of guiding device 1 is at an axial position in the range of 50%-70% of the width measured from cover plate 20. In the exemplary embodiment, guiding elements 3 have a rather small axial extension, the axial extension of guiding elements 3 being about 20%-60% of the axial width of outlet 31 of impeller 19, thereby achieving an axially compact design.

FIG. 12 shows a side and sectional view on a plane through the axis of guiding device 1 and impeller 19 according to FIGS. 8 and 10 to 11, with an inlet nozzle 9 installed in a housing 2 embodied as a pressure-side air duct. In this housing 2, downstream of impeller 19, the air continues in a direction roughly parallel to the axis. Guiding device 1 shown can be used in this configuration particularly advantageously. The air exiting from impeller 19 at outlet 31 is partitioned between two flow-through sections, outer flow-through section 6, on the one hand, and inner flow-through section 7, on the other hand. Outer ring 5 of guiding device 1 represents the separation between the two flow-through sections 6 and 7. Across a large part of its span, outer flow-through section 6 has substantially no other guiding elements. In contrast, inner flow-through section 5 has guiding elements 3, of those 4 in the exemplary embodiment, which stabilize the swirling air coming from impeller 19 in flow-through section 7 closer to the axis by reducing the swirl. A particularly significant gain in efficiency can be achieved if the side walls of housing 2 are relatively close to outlet 31 from impeller 19, in particular if the width of the duct (=the width of housing 2, seen in the cross-section and in the radial direction, at the level of outlet 31) is less than 1.6 times the largest diameter of impeller 19 at least in some sections, which is often the case due to the compact design of such housings 2.

Guiding device 1 must be fastened to housing 2 by a suspension (not shown). Advantageously, this can be accomplished by extending one, several or all guiding elements 3 up to the wall of housing 2.

FIG. 12*a* shows an axial top view, seen from the outflow side, of a housing 2, a guiding device 1 and an impeller 19 of another embodiment of a fan. Outer rim 24 of base plate 21 of impeller 19 is located within inflow-side rim 23 of outer ring 5 of guiding device 1. This allows to push guiding device 1 over base plate 21. Unlike in embodiments according to FIGS. 7-12, guiding elements 3 are not curved. This significantly facilitates manufacturing guiding elements 3 from sheet metal. To still achieve good flow properties, high efficiency and a low noise level, guiding elements 3 are twisted or tilted relative to the radial direction. In the radial section of inflow-side end 23 of outer ring 5, the twist angle from the local radial line is about 30°, advantageously 15°-45°. In the exemplary embodiment, at inner end 11, guiding elements 3 meet hub ring 4 at an acute angle. Hub ring 4 and guiding elements 3 are advantageously made of sheet metal and connected to each other by welding or screws. Due to its contour as a solid of revolution (similar to the outer ring according to FIGS. 7-12), outer ring 5 is advantageously manufactured as a casing, in particular as a plastic injection-molded part. The connection of guiding elements 3 at their outer ends 12 to outer ring 5 is advantageously accomplished by snapping them on, screws, rivets or the like. Corresponding arrangements can be present on the injection-molded part.

The suspension of guiding device 1 and thus also the motor and impeller 19 at housing 2 is accomplished using suspension 32, integrating the functionality of some guiding elements. The geometry of suspension 32 radially within outer ring 5 of guiding device 1 approximately corresponds to the geometry of remaining guiding elements 3. Advantageously, suspension 32 is made of sheet metal and is fastened to housing 2 using fastening 33, advantageously using screws or rivets. This functional integration results in a particularly cost-effective manufacture. Suspension 32 with the integrated guiding element functionality also passes through outer flow-through section 6. As there are additional guiding elements 3 in inner flow-through section 7, the fact that outer flow-through section 6 has substantially no guiding elements, at least compared to inner flow-through section 7, also applies to the embodiment. Advantageously, no more than half the number of suspension-specific elements extend in an outer flow-through section 6. This is not much compared to inner flow-through section 7, as outer flow-through section 6 additionally has a substantially larger cross-sectional area than inner flow-through section 7, and the distance of adjacent suspensions 32, seen in the circumferential direction, is therefore large compared to the distance of adjacent guiding elements 3 in inner flow-through section 7 when taking the integrated suspensions/guiding elements 32 into consideration.

FIG. 13 shows a perspective view, seen from the outflow side, of a guiding device 1 and a housing 2 of another exemplary embodiment of an axial-type fan. Suspension struts 25 are shown schematically, which form the connection between guiding device 1 and housing 2 in this load-bearing embodiment of guiding device 1. Suspension struts 25 may be made of sheet metal, bar stock or molded, then advantageously provided with a flow-compatible shape. With suspension struts 25 made of flat material, it may also be contemplated that they are not axially aligned, but attached at a fluidically favorable angle from the axial direction. Despite the presence of suspension struts 25, outer flow-through section 6 should be considered substantially free of guiding elements, at least in comparison to inner flow-through section 7. Suspension struts 25 can be connected to housing 2 and/or outer ring 5 of guiding device 1 by screws, rivets, welding or the like. One-piece, monolithic, integral manufacture of the entire housing 2 and guiding device 1 with suspension struts 25 as a casting may also be contemplated.

Similar to the exemplary embodiment according to FIGS. 1-6, guide vanes 3 have a tilted part 16 on the inflow side, an axially aligned part 15 on the outflow side and a transition section 17 to combine the implementation of flow compatible inflow angles with an easy demoldability of guiding device 1, in particular if hub ring 4 and/or outer ring 5 of guiding device 1 have a conical profile in at least some sections. Here, transition section 17 is formed as a rounded section, connecting tilted part 16 and axially aligned part 15 by a constant tangent.

FIG. 14 shows an axial top view, seen from the inflow side, of guiding device 1 and housing 2 according to FIG. 13. Guiding device 1 has 11 guiding elements 3. The 4 suspension struts 25 are distributed across the periphery slightly irregularly as they are always arranged approximately between adjacent guiding elements 3 in their circumferential position. Unlike the embodiments shown in FIGS. 1-12 and 12*a*, outer ring 5 of guiding device 1 is not embodied as a solid of revolution. However, it still runs across the entire periphery and connects guiding elements 3 to each other at their outer ends 12. Outer ring 5 is not adapted to be axially aligned, but is substantially conical with specifically configured demolding sections 26 in the proximity of guide vanes 3, which are operable to enable or facilitate the demolding of guiding elements 3 from a molding die. That is, in demolding sections 26, for undercut-free demolding in the axial direction, outer ring 5 is adapted to be locally axially aligned.

Between axially aligned sections 26 and conical sections 27 of outer ring 5, transition sections with a constant tangent may be formed in a section between adjacent guide vanes 3, on the one hand, and step-like transitions sections may be formed in the section of guide vanes 3, on the other hand, wherein the shape of the steps approximately corresponds to the continuation of the contour of guide vanes 3. In other words, a section of guide vane 3 close to its outer end 12 connects an axially aligned part 26 of outer ring 5 to a conically shaped part 27 of outer ring 5. Here, the configuration of the guiding elements with tilted part 16 and axially aligned part 15, already described with reference to FIG. 13, in particular results in the circumferential extension of a guide vane 3, in particular close to outer end 12, being very small. This minimizes the circumferential section in which outer ring 5 must be configured in the form of a demolding section 26 in the shape of a cylinder barrel to achieve undercut-free demoldability, which is advantageous, in particular for efficiency.

FIG. 14 clearly shows outer flow-through section 6 with few guiding elements and inner flow-through section 7 with many guiding elements. Here, the section within hub ring 4 is not shown in detail, but may be configured similar to the embodiments according to FIGS. 1-12, 12*a*.

FIG. 15 shows a side and sectional view on a plane through the axis of guiding device 1 and housing 2 according to FIGS. 13 and 14. The at least partly conical configuration of outer ring 5 of guiding device 1 can be seen clearly. In the embodiment shown, this outer ring 5 is configured such that the radius (distance from the axis) of the contour decreases, when seen in the flow-through direction. By contrast, hub ring 4 is configured to be axially aligned in the shape of a cylinder barrel here. So, the cross-section of inner flow-through section 7, defined by hub ring 4 towards the axis and defined by outer ring 5 towards outer flow-through section 6, is tapered from left to right in the flow-through direction (in the diagram shown). Thus, inner flow-through section 7 is formed as a confusor. This configuration results in additional stabilization of the swirling flow from the impeller (not shown) close to the axis, thereby achieving an additional increase in efficiency. Furthermore, a particular advantageous long-cast of the air exiting into the open from flow-through sections 6 and 7 on the outflow side is achieved, that is, the air jet remains compact over a long distance and has high air velocities over a long distance in the area of the imagined continuation of the axis, which is advantageous for some fan applications.

The kind of embodied conical configuration of outer ring 5 of guiding device 1 also influences the cross-sectional profile of outer flow-through section 6. Therefore, this flow-through section 6 takes on the character of a diffusor. Thus, to obtain a desired cross-sectional expansion of flow-through section 6, the conical aperture angle of outer diffusor wall 10 integrated in housing 2 may be chosen to be rather less large when compared to the case of a configuration of outer ring 5 in the shape of a cylinder barrel. This lowers the outer diameter at the outflow-side outlet from housing 10, enabling a compact design. If required, with such a conical configuration of inner ring 5, the formation of diffusor 10 on housing 2 could even be omitted, that is, housing 2 could be configured with an axially aligned contour in the shape of a cylinder barrel towards its outflow-side end, simplifying the manufacture of housing 2.

The sectional view clearly shows the structure of guide vanes 3 with tilted part 16, axially aligned part 15 and transition section 17 with a constant tangent. As suspension struts 25, axially aligned in the exemplary embodiment, are distributed irregularly across the periphery, the sectional view only shows the upper one of struts 25; the others cannot be seen. FIG. 15 shows receiving section 8 within hub ring 4 with a fastening arrangement 18 for a motor of the fan.

FIG. 16 shows an axial top view, seen from the outflow side, of a housing 2, a guiding device 1 and an impeller 19 of a further embodiment of a fan. In this embodiment, guiding device 1 is substantially made of sheet metal and is therefore advantageously constructed from substantially planar sub-sections. In particular, there are no sections of significant curvature. The impeller 19 shown, of which base plate 21, cover plate 20 and vanes 19 can partly be seen, is a centrifugal impeller. Housing 2 is a flow duct having a quadrangular cross-section, in which the air, having exited impeller 19 or guiding device 1, is guided further in the axial direction, in the view towards the observer. In this viewing direction, the outer contour of guiding element 1 or its outer ring 5 also has a quadrangular contour. It is rotationally symmetric, divided in four, but not a solid of revolution in this case. This can facilitate construction of guiding element 1 from planar sections, which substantially facilitates the manufacture of guiding element 1 from sheet metal. Moreover, a quadrangular outer contour of guiding element 1 is particular suitable fluidically if housing 2 also has a quadrangular cross-section. This provides outer flow-through section 6 with a largely constant width, defined by the distance of outer ring 5 of guiding device 1 and the wall of housing 2, forming the inner and outer boundary of outer flow-through sections 6, respectively.

Inner flow-through section 7, defined radially inwards by hub ring 4 and radially outwards by outer ring 5, is interspersed with guiding elements 3. Corresponding to the easy manufacture from sheet metal, these are also embodied as planar parts. In the exemplary embodiment, they are embodied as axially aligned parts 15, i.e., parallel to the fan axis. Also hub ring 4 has the fluidically advantageous quadrangular contour parallel to the contour of housing 2 or to the contour of outer ring 5. A fastening section 18 for the stator side of a motor (not shown) is provided at hub ring 4. A fastening arrangement 30 for the rotor side of the motor can be seen on base plate 21 of impeller 19.

Outer ring 5, too, is substantially made of planar sections 5*a*, 5*b*, 5*c*. The circular inflow-side rim 23 is associated with planar section 5*c* which runs perpendicularly to the fan axis. This ensures a favorable inflow angle relative to the flow exiting impeller 19 in approximately the radial direction. The outflow-side rim 28 is associated with planar sections 5*a* which are parallel to the fan axis and thus parallel to the airflow direction in housing or flow duct 2 in the embodied section. Between planar sections 5*c* and 5*a*, planar transition sections 5*b* are also formed which promote low-loss deflection of the air exiting impeller 19 radially into the axial direction.

In this embodiment, the outer side length of guiding device 1, as seen in this view, is about 1.15 times, advantageously 1.1-1.2 times, the outer diameter at outer rim 24 of base plate 21 of impeller 19. Such a ratio is particularly suited for tight installation spaces, i.e., if the side length of housing 2, seen in the cross-section, is less than 1.6 or 1.5 times the average diameter of the trailing edges of vanes 22 of impeller 19 relative to the fan axis.

FIG. 17 shows housing 2, guiding device 1 and impeller 19 according to the embodiment of FIG. 16 in a side and sectional view on a plane through the axis. The sectional view clearly shows the planar sections of outer ring 5 of guiding device 1. Outflow-side, axially parallel section 5*a*, planar transition section 5*b* and inflow-side section 5*c*, bounded on the inside by inflow-side rim 23 of outer ring 5.

In the exemplary embodiment, seen in spanwise direction of impeller 19, inflow-side rim 23 of outer ring 5 of guiding device 1 is closer to base plate 21 than to cover plate 20, for about 75% (advantageously 60%-80%) of the span, as seen from the cover. This is also advantageous for tight installation spaces for impeller 19 relative to housing 2, i.e., if the side length of housing 2, as seen in the cross-section, is less than 1.6 or 1.5 times the average diameter of the trailing edges of vanes 22 of impeller 19 relative to the fan axis. In any other respect, reference is made to the description of other embodiments, for example according to FIG. 12.

Guiding device 1 of the embodiment shown in FIG. 17 can readily be made of sheet metal, as it is constructed from planar sections. To this end, one or more sheet metal parts are cut or punched, canted as appropriate, and joined, where required, for example by using welding, lugs, clinching, rivets or screws.

Guiding device 1 can be adapted to be load-bearing or non-load-bearing. Suspension elements, fastening impeller 19 and guiding device 1 to housing 2, are not shown.

FIG. 18 shows an axial top view, seen from the outflow side, of a housing 2, a guiding device 1 and an impeller 19 of a further embodiment of a fan. The fan is very similar in structure to the exemplary embodiment according to FIGS. 16 and 17; however, guiding elements 3 are formed with tilted sections 16, connecting up to axially aligned parts 15 on the inflow side. Thus, inflow losses of guiding device 1 can be reduced by a more suitable inflow angle of the swirling flow exiting impeller 19. Tilted parts 16 are also embodied as planar sections. In any other respect, reference is made to the explanations with respect to FIGS. 16 and 17.

Regarding further advantageous embodiments and the guiding device, reference is made to the general section of the description and the claims to avoid repetition.

Finally, it is important to note that the exemplary embodiments of the fan and the guiding device described above are only set forth for the purpose of disclosing various embodiments, but do not limit it to the exemplary embodiments.

LIST OF REFERENCE NUMERALS

1 Guiding device, outlet guiding device
2 Housing
3 Guiding element, guide vane, outlet guide vane
4 Hub ring, inner ring of the guiding device
5 Outer ring of the guiding device, annular flow element
5*a,b,c* Planar sections of the outer ring of the guiding device
6 Outer flow-through section
7 Inner flow-through section
8 Receiving section within the hub ring
9 Inlet nozzle
10 Outer diffusor
11 Inner end of a guiding element
12 Outer end of a guiding element
13 Leading edge of a guiding element
14 Trailing edge of a guiding element
15 Axially aligned part of a guiding element
16 Tilted part of a guiding element
17 Transition section of a guiding element
18 Fastening arrangement in the receiving section
19 Impeller
20 Cover plate of the impeller
21 Base plate of the impeller
22 Vane of the impeller
23 Inflow-side rim of the outer ring of the guiding device
24 Outer rim of the base plate of the impeller
25 Suspension strut
26 Axially aligned section of the outer ring, demolding section
27 Conical section of the outer ring
28 Outflow-side rim of the outer ring of the guiding device
29 Section for an impeller
30 Fastening arrangement for a motor on the impeller
31 Flow outlet from the impeller
32 Suspension
33 Fastening of the suspension to the housing
34 Motor
35 Rotor of the motor
36 Stator of the motor
37 Hub cap
38 Hub ring of the impeller

The invention claimed is:

1. A fan, comprising:
a housing having a flow channel;
an impeller;
an outlet guide device located within the housing downstream of the impeller, wherein the outlet guide device comprises outlet guide blades that extend over only a portion of the flow channel along a radial direction of the fan, wherein the outlet guide blades extend between a hub ring and an outer ring and wherein the outlet guide device is configured as a diffusor having a gradually expanding flow cross-section when viewed in a flow-through direction;
an inner flow-through region located downstream of the impeller between the hub ring and the outer ring; and
an outer flow-through region peripheral to the inner flow-through region located between the outer ring and a wall of the housing.

2. The fan according to claim 1, wherein the outlet guide blades extend over approximately half of the flow channel along the radial direction.

3. The fan according to claim 1, wherein a diameter of the outlet guide device is less than a diameter of the impeller.

4. The fan according to claim 1, wherein the outlet guide blades are connected at respective radial ends to an annular flow element located within the housing.

5. The fan according to claim 4, wherein the annular flow element is configured as a rotationally symmetric body with respect to an axis of the fan.

6. The fan according to claim 4, wherein the annular flow element tapers conically from an intake side of the fan to an outflow side of the fan, the annular flow element being demoldable from a casting mold without an undercut when viewed along an axial direction.

7. The fan according to claim 4, wherein a contour of the annular flow element is increasingly curved from an outflow side of the fan to an inlet side of the fan, the annular flow element configured to present a small angle of incidence to a radial flow exiting the impeller and deflect the flow along an axial direction parallel to an axis of the fan.

8. The fan according to claim 1, wherein the outlet guide blades comprise a sickle-shaped profile along their radial extension having a curvature opposite to a direction of rotation of the impeller.

9. The fan according to claim 8, wherein the outlet guide blades comprise an angle of inclination greater than 30°.

10. The fan according to claim 8, wherein the outlet guide blades each comprise an intake-side region, an outflow-side region, and a respective transition region disposed therebetween, the intake-side regions each having a profiled cross-section of an airfoil with an intake angle ranging from 20° to 50° relative to an axis of the fan, the outflow-side regions each extending parallel to the axis of the fan, and the transition regions each comprising a constant tangent or a constant curvature.

11. The fan according to claim 1, wherein the outlet guide device comprises or forms at least a part of a suspension element.

12. The fan according to claim 11, wherein the outlet guide device comprises an outer contour configured to engage the suspension element.

13. The fan according to claim 11, further comprising a flange for attaching a motor on an intake side of the inner contour of the outlet guide device, the motor and the impeller being suspended proximate the flow channel.

14. The fan according to claim 4, further comprising suspension struts that extend between the annular flow element and a wall of the housing, wherein the suspension struts have a configuration selected from the group consisting of upright when viewed in an axial direction of the fan, curved, and inclined parallel to the outlet guide blades.

15. The fan according to claim 11, wherein at least one of the outer guide blades extends radially to a wall of the flow channel or a portion of the housing.

16. The fan according to claim 1, wherein the outlet guide device comprises planar segments formed from sheet metal.

17. A fan comprising:
an impeller disposed within a housing, the impeller comprising a plurality of impeller blades;
a guide device disposed within the housing downstream of the impeller, the guide device comprising guide elements that extend between a hub ring and an outer ring;
an inner flow-through region located downstream of the impeller between the hub ring and the outer ring; and
an outer flow-through region peripheral to the inner flow-through region located between the outer ring and a wall of the housing.

18. The fan according to claim 17, wherein an intake-side edge of the outer ring is located downstream of the impeller blades and, when viewed in a radial direction, the intake-side edge of the outer ring is located between opposing ends of the impeller blades.

19. The fan according to claim 18, wherein the intake-side edge of the outer ring is located within a range of 20-80% of an extension of the impeller blades along the radial direction.

* * * * *